US005466311A

United States Patent [19]

Hu et al.

[11] Patent Number: 5,466,311

[45] **Date of Patent: * Nov. 14, 1995**

[54] METHOD OF MANUFACTURING A NI-A1 INTERMETALLIC COMPOUND MATRIX COMPOSITE

[75] Inventors: Chen-Ti Hu, Taipei; Wen-Chih Chiou, Miaoli, both of Taiwan

[73] Assignee: National Science Council, Taipei, Taiwan

[ * ] Notice: The portion of the term of this patent subsequent to Oct. 17, 2012, has been disclaimed.

[21] Appl. No.: 196,012

[22] Filed: Feb. 10, 1994

[51] Int. Cl.[6] ..... B22F 1/00; B22F 3/12

[52] U.S. Cl. ..... 148/513; 419/19; 419/23; 419/24; 419/30; 419/35; 419/36; 419/38; 419/44; 419/49; 419/54; 419/57; 419/10; 427/217

[58] Field of Search ..... 419/10, 19, 23, 419/24, 30, 35, 36, 38, 44, 49, 54, 57; 148/513; 427/217

[56] References Cited

PUBLICATIONS

'Elemental Powder Approaches to $Ni_3A1$–Matrix Composites'; A. Bose et al; Journal of Metals, Sep. 1988; pp. 14–17.

'Microstructures and Mechanical Behavior of Mechanically Alloyed Nickel Aluminide'; J. Wang et al; The International Journal of Powder Metallurgy, vol. 24, No. 4, pp. 315–325.

*Primary Examiner*—Donald P. Walsh

*Assistant Examiner*—Daniel Jenkins

*Attorney, Agent, or Firm*—Christie, Parker & Hale

[57] ABSTRACT

A method of manufacturing an Ni—Al intermetallic compound matrix composite comprising steps of a) providing an aluminum powder, b) providing a reinforced material, c) providing a reducing solution containing a reducing agent and nickel ions to be reduced, d) adding the aluminum powder and the reinforced material into the reducing solution, and e) permitting the reducing agent to reduce the nickel ions to be respectively deposited on the aluminum powder and the reinforced material. Such method permits the Ni—Al, Ni—Al +B intermetallic compound matrix composite to be produced inexpensively/efficiently/fastly.

37 Claims, 8 Drawing Sheets

METHOD OF MANUFACTURING A NI-A1 INTERMETALLIC COMPOUND MATRIX COMPOSITE

BACKGROUND OF THE INVENTION

The present invention relates generally to a method of manufacturing an Ni—Al intermetallic compound matrix composite.

FIELD OF THE INVENTION

The Ni—Al intermetallic compounds such as $Ni_3Al$ has demonstrated extraordinary properties: high melting point, high ordering energy, thermal hardening, good resistance to oxidation and relatively small density. Further, some of these properties are even superior to those of the nickel-base super-alloy. Those advantages make it attractive for aerospatial and structural applications at elevated temperatures.

Owing to the fact that the specific weight of the $Ni_3Al$ is 7.5 g/cm$^3$ which is larger than that of most ceramic materials, if the ceramic reinforced material which is stronger and less heavy than $Ni_3Al$ is added into $Ni_3Al$ to form a composite material, the specific weight is lowered and the strength is raised. Because of the chemical compatibility and the thermal expansion coefficient of $\alpha$-$Al_2O_3$, $\alpha$-$Al_2O_3$ is suitable for being a reinforced material of Ni Al composite.

For manufacturing uncontinuous fiber-, whisker- or particle-reinforced composite material, the powder metallurgy (PM) method is generally used. The developed powder metallurgy methods include sintering, hot pressing, hot isostatic pressing, and hot extrusion etc. Jason S. C. Wang et al proposed (in THE INTERNATIONAL JOURNAL OF POWDER METALLURGY, VOL. 24, No. 4, PP. 315–325) that a series of polycrystalline nickel aluminide (Ni-23.5 at. % Al-0.5 at. % Hf-0.2 at. % B) powders without or with 0.5 vol. % to 2.5 vol. % $Al_2O_3$, $Y_2O^3$, or $ThO_2$ additions were mechanically alloyed (MA) in either air or argon atmospheres and consolidated by hot isostatic pressing.

This method has the following disadvantages:

1) The size of the final product is limited by the capacity of HIP equipment.
2) The elongation of the final product is not so satisfactory. From all the examples disclosed therein, the additions of $Al_2O_3$ are less than 3.5 vol. %, but the resulting elongations are all under 3.6%.
3) It wastes lots of time.
4) The equipments therefor are relatively expensive.
5) The production rate thereof is relatively low.
6) It takes too many steps.

A. Bose et al proposed (in JOURNAL OF METALS, September 1988 pp. 14–17) full density $Ni_3Al$ intermetallic-matrix composites which are obtained by reactive sintering and hot isostatic compaction of mixed elemental powders. One of the final products, whose composition is $Ni_3Al$+B+3 v/o $\alpha$-$Al_2O_3$, has a yield strength 474 MPa and an elongation 1%.

A. Bose et al considered the most serious problems existing in this method, namely:

1) Oxygen levels are relatively high, thereby contributing to the reduced ductility.
2) In the final product, the boron is inhomogeneously distributed.

It is a common problem in the powder metallurgy press that the oxygen levels are relatively high. Whereas, the problem of inhomogeneously distributed boron can be overcome by the present method.

It is therefore attempted by the Applicant to deal with the above situation encountered by the prior art.

SUMMARY OF THE INVENTION

One objective of the present invention is to provide a method of manufacturing an Ni—Al intermetallic compound matrix composite.

Another objective of the present invention is to provide a method of manufacturing an Ni—Al intermetallic compound matrix composite first by replacement reaction to form nickel layer on the surface of the aluminum powder, and then by oxidation and reduction reaction to deposit the reduced nickel ions on the nickel layers of the aluminum powder, the surface of nickel powder and the surface of reinforced material.

A further another objective of the present invention is to provide a method of manufacturing an Ni—Al intermetallic compound matrix composite having a better interphase bonding by the uniform plating layers on the powders.

A yet objective of the present invention is to provide an Ni—Al intermetallic compound matrix composite whose nickel layer can lessen or avoid the oxidation of the aluminum powder.

Still an objective of the present invention is to provide a method for manufacturing an Ni—Al intermetallic compound matrix composite, in which the wetness between the basic materials and the reinforced material is increased.

One more objective of the present invention is to provide an Ni—Al intermetallic compound matrix composite softer than the intermetallic pre-alloyed powder for being green formed easily.

Still more objective of the present invention is to provide a method for manufacturing an Ni—Al intermetallic compound matrix composite which can shorten the diffusion distance of the individual atom upon forming the Ni—Al intermetallic compound matrix composite.

Yet more objective of the present invention is to provide an Ni—Al intermetallic compound matrix composite having a higher constituent uniformity.

Further more objective of the present invention is to provide a method for manufacturing an Ni—Al intermetallic compound matrix composite, whose electroless plating solution containing boron ions permits the boron uniformly distributed in the plating layer without step of adding boron or boron alloy.

Once more objective of the present invention is to provide a method of manufacturing an Ni—Al intermetallic compound matrix composite, which can solve the problems of processing difficulty and difficult formation for enabling the final product to be of a desired large size.

Further once more objective of the present invention is to provide a method of preparing an Ni—Al intermetallic compound matrix composite, which applies inexpensive and simple equipments.

Still once more objective of the present invention is to provide a method of preparing an Ni—Al intermetallic compound matrix composite, which can achieve the effect of uniform mixing for the aluminum powder, the nickel powder and the reinforced material only by controlling the particle diameter ratio.

In accordance with one aspect of the present invention, a method of manufacturing an Ni—Al intermetallic compound matrix composite includes steps of a) providing an aluminum powder, b) providing a reinforced material, c) providing a reducing solution containing a reducing agent and nickel ions to be reduced, d) adding the aluminum powder and the reinforced material into the reducing solution, and e) permitting the reducing agent to reduce the nickel ions to be reduced to be respectively deposited on the aluminum powder and the reinforced material.

Certainly, the reinforced material can be whisker-shaped. The whisker-shaped reinforced material can have a length from about 0.1 μm to about 10 cm.

Alternatively, the reinforced material can be particle-shaped. The particle-shaped reinforced material can have a diameter from about 0.1 μm to about 100 μm.

Certainly, the reinforced material can be $\alpha$-$Al_2O_3$. The $\alpha$-$Al_2O_3$ can be processed by a pre-treatment procedure. The pre-treatment procedure can include steps of f) dipping the $\alpha$-$Al_2O_3$ in a first sensitizing and activating solution, g) flushing the $\alpha$-$Al_2O_3$ with water, h) dipping the $\alpha$-$Al_2O_3$ in a second sensitizing and activating solution, and i) flushing the $\alpha$-$Al_2O_3$ with water. The first sensitizing and activating solution can include stannum chloride ($SnCl_2.H_2O$), hydrogen chloride (HCl), and water ($H_2O$). The second sensitizing and activating solution can include palladium chloride ($PdCl_2$), hydrogen chloride (HCl), and water ($H_2O$).

Certainly, the reinforced material can be a ceramic powder or whiskers. The ceramic powder or whiskers can be one selected from a group consisting of an oxide, a nitride, a carbide, and a boride.

Certainly, the aluminum powder can be processed by a pre-treatment procedure. The pre-treatment procedure can include steps of defatting the aluminum powder, flushing the aluminum powder with a basic solution, and flushing the aluminum powder with an acid solution. The pre-treatment procedure can further include a step of subjecting the aluminum powder to an ultrasonic vibration to speed up a reaction therefor and improve a uniformity of the aluminum powder.

Alternatively, the pre-treatment procedure can include steps of i) providing the aluminum powder, j) providing a replacing solution containing replacing nickel ions, and k) permitting the replacing nickel ions to replace aluminum ions ionized from the aluminum powder for forming a thin mono-layer of nickel on a surface of the aluminum powder.

Certainly, the replacing solution can include a metal salt and a reducing agent. The replacing solution can further include at least one selected from a group consisting of a pH regulator, a buffer, a complexing agent, a stabilizer, and an improver.

Certainly, the replacing solution can have a pH value ranging from about 8 to about 9 and a reaction temperature at room temperature, and includes nickel chloride ($NiCl_2.6H_2O$), sodium citrate ($Na_3C_6H_5O_7.2H_2O$), and ammonia chloride ($NH_4Cl$), sodium fluoride (NaF).

Certainly, the method can further include after step e) steps of o) providing a pure nickel powder, p) adding a proper amount of the pure nickel powder in the reducing solution at a proper time for adjusting a ratio of the aluminum and the nickel, and q) obtaining an Ni—Al, Ni—Ni, and Ni—reinforced material composite powder.

Certainly, the reducing solution can contain boron ions. The method can further include after step e) steps of o') providing a pure nickel powder, p') adding a proper amount of the pure nickel powder in the reducing solution at a proper time for adjusting a ratio of the aluminum, the boron, and the nickel, and q') obtaining an Ni—B—Al, Ni—B—Ni, and Ni—B— reinforced material composite powder.

Certainly, the reinforced material can be $\alpha$-$Al_2O_3$ particles. The aluminum powder, the nickel powder, and the $\alpha$-$Al_2O_3$ particles can have a diameter ratio from about 2.0:1:1.1 to about 2.5:1:2.0. The aluminum powder, the nickel powder, and the $\alpha$-$Al_2O_3$ particles can have a preferred diameter ratio 2.2:1:1.7.

Certainly, the method can further include after step q') steps of r) drying the composite powder, s) degassing the composite powder at about 450° C. under less than about $10^{-5}$ torr, t) canning the composite powder in a stainless steel tube in air, u) sealing both ends of the tube, and x) cold-rolling the tube containing the composite powder to form a composite flake. The composite flake can be pre-sintered by a first heat treatment at about 650° C. for forming a pre-sintered specimen. The pre-sintered specimen can be sintered by a second heat treatment at about 1200° C. for forming a sintered specimen. The sintered specimen can be then released from the tube, cold-rolled, and homogenized at about 1200° C.

Certainly, the reducing solution can include a metal salt and a reducing agent. The reducing solution can further include a pH value regulator, a buffer, a complexing agent, a stabilizer, and an improver. The reducing solution can have a pH value ranging from about 6 to about 7 and a reaction temperature about 70° C., and includes nickel chloride ($NiCl_2.6H_2O$), dimethylamine borane (DMAB), sodium acetate ($CH_3COONa.3H_2O$), and lead nitrate ($Pb(NO_3)_2$).

Alternatively, the reducing solution can have a pH value ranging from about 7 to about 8 and a reaction temperature about 70° C., and includes nickel chloride ($NiCl_2.6H_2O$), dimethylamine borane (DMAB), sodium citrate ($Na_3C_6H_5O_7.2H_2O$), ammonia chloride ($NH_4Cl$), and lead nitrate ($Pb(NO_3)_2$).

Alternatively, the reducing solution can have a pH value ranging from about 6 to about 7 and a reaction temperature about 70° C., and includes nickel chloride ($NiCl_2.6H_2O$), dimethylamine borane (DMAB), monalic acid ($HOOCH_2COOH$), and thiourea ($NH_2COSC_2H_5$).

Alternatively, the reducing solution can have a pH value ranging from about 8 to about 10 and a reaction temperature at room temperature, and includes nickel chloride ($NiCl_2.6H_2O$), sodium brohydride ($NaBH_4$), ammonia chloride ($NH_4Cl$), sodium citrate ($Na_3C_6H_5O_7.2H_2O$), sodium acetate ($CH_3COONa.3H_2O$), and lead nitrate ($Pb(NO_3)_2$).

Certainly, the Ni—Al intermetallic compound can be one selected from a group consisting of $Ni_3Al$, NiAl, $Ni_2Al_3$, $NiAl_3$, $Ni_3Al$+B, NiAl+B, $Ni_2Al_3$+B, and $NiAl_3$+B.

Certainly, the aluminum powder can have a purity about 99.5% and an average diameter about 20 μm.

The present invention can be more fully understood by reference to the following description and accompanying drawings which form an integral part of this application:

DETAILED DESCRIPTION OF THE PREFERRED EMBODIMENT

Figure 1:
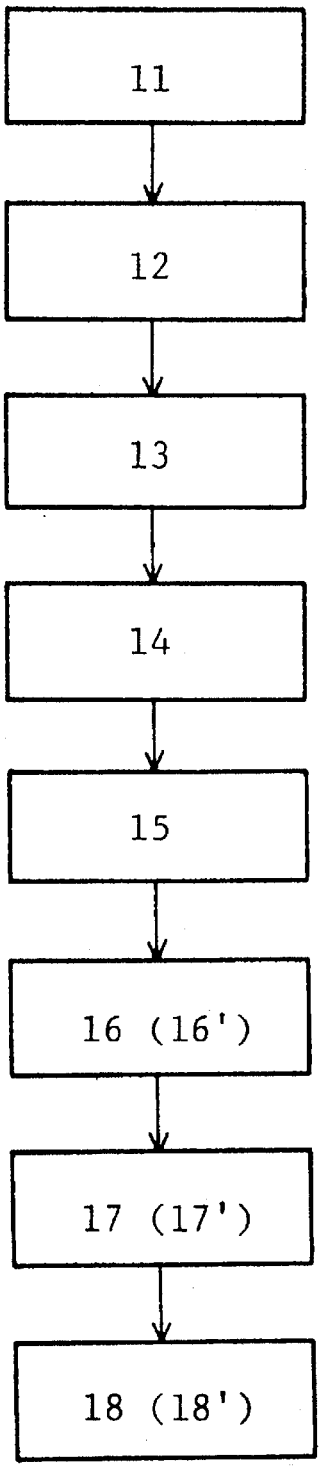
FIG. 1 is a flow chart for a method of manufacturing an Ni—Al intermetallic compound matrix composite according to the present invention.

FIG. 1 is a flow chart showing manufacturing procedures for an Ni—Al intermetallic compound matrix composite.

This method of manufacturing an Ni—Al intermetallic compound matrix composite according to the present invention includes steps of:

a) providing an aluminum powder (11);

b) providing a reinforced material (12);

c) providing a reducing solution containing a reducing agent and nickel ions to be reduced (13);

d) adding the aluminum powder and the reinforced material into the reducing solution (14); and e) permitting the reducing agent to reduce the nickel ions to be reduced to be respectively deposited on the aluminum powder and the reinforced material (15).

The detailed conditions for the reducing solution in step c) are shown in TABLE 1.

The present method further includes after step e) steps of:

o) providing a pure nickel powder (16);

p) adding a proper amount of the pure nickel powder in the reducing solution at a proper time for adjusting a ratio of the aluminum and the nickel (17); and q) obtaining a Ni—Al, Ni—Ni, and Ni— reinforced material composite powders (18).

Alternatively, when the reducing solution contains boron ions, the present method further includes after step e) steps of:

o') providing a pure nickel powder (16');

p') adding a proper amount of the pure nickel powder in the reducing solution at a proper time for adjusting a ratio of the aluminum, the boron, and the nickel (17'); and q') obtaining Ni—B—Al, Ni—B—Ni, and Ni—B— reinforced material composite powders (18').

In step o')–step q'), the aluminum powder, the nickel powder and the reinforced material are added and then suspended in the reducing solution. For sparing the extra procedure for mixing the aluminum powder, the nickel powder and the reinforced material which have been plated with a nickel layer, the diameter ratio of powders with different specific weights is precisely controlled so that these powders have the same precipitating speed.

Thus after the plating is finished, the powders with different specific weights have been uniformly mixed, i.e., during the plating, the purpose of the uniform mixing is achieved. Generally speaking, the aluminum powder, the nickel powder, and the $\alpha$-$Al_2O_3$ particles have a diameter ratio from about 2.0:1:1.1 to about 2.5:1:2.0, and preferably, the aluminum powder, the nickel powder, and the $\alpha$-$Al_2O_3$ particles have a diameter ratio of 2.2:1:1.7.

The present method further includes after step q) or q') steps of:

TABLE 1

| | REDUCING PLATING CONDITION 1 | REDUCING PLATING CONDITION 2 | REDUCING PLATING CONDITION 3 | REDUCING PLATING CONDITION 4 |
|---|---|---|---|---|
| nickel chloride | 72 g/l | 60 g/l | 30 g/l | 30 g/l |
| DMAB | 6 g/l | 10 g/l | 3.5 g/l | |
| sodium brohydride | | | | 2 g/l |
| sodium acetate | 22 g/l | | | 20 g/l |
| sodium citrate | | 100 g/l | | 10 g/l |
| ammonia chloride | | 50 g/l | | 5 g/l |
| monalic acid | | | 40 g/l | |
| lead nitrate | 2 ppm | 2 ppm | | 5 ppm |
| thiourea | | | 1 ppm–4 ppm | |
| pH value | 6–7 | 7–8 | 6–7 | 8–10 |
| reaction temperature | 70°C. | 70°C. | 70°C. | room temperature |

r) drying the composite powder (19);

s) degassing the composite powder at about 450° C. under less than about $10^{-5}$ torr (20);

t) canning the composite powder in a stainless steel tube in air (21);

u) sealing both ends of the tube (22); and x) cold-rolling the tube containing the composite powder to form a composite flake (23).

In step r)–step x), the composite powders are first canned in a SUS304 stainless steel tube in air, then both ends of the tube are mechanically sealed to form a canister. Thereafter, the mixture is processed by a first thermal treatment with less than $10^{-5}$ torr at about 450° C. in a vacuum tube furnace to be degassed, and a cold rolling to about 60% reduction in area is followed to form test flakes. It is to be noticed that the composite powders absorbs therein the hydrogen atoms generated during the electroless plating procedure because of the excellent hydrogen-absorbing behavior of nickel. Then the degassing procedure is therefore very important. The test flakes are processed by a second heat treatment at about 650° C. to form a presintered specimens, which are then reduced about 30% in area by cold-rolling in a DBR-250 rolling mill and sintered at about 1200° C. for two hours in the same furnace. After being released from the canister, the sintered specimens are coll-rolled to another about 20% reduction in area and homogenized at about 1200° C. for four hours in the same furnace.

The reinforced material according to the present invention can be a ceramic powder such as an oxide, a nitride, a carbide or a boride, a whisker-shaped one having a length from about 0.1 μm to about 10 cm, or a particle-shaped one having a diameter from about 0.1 μm to about 100 μm.

According to the present invention, the reinforced material is $\alpha$-$Al_2O_3$, and it has to be processed by a pretreatment procedure. There are two kinds of pre-treatment procedures for the aluminum powder according to the present invention, namely:

The first kind including procedures (A):

f) dipping the $\alpha$-$Al_2O_3$ in a first sensitizing and activating solution including stannum chloride ($SnCl_2.H_2O$) 10 g, hydrogen chloride (9.6N) (HCl) 40 ml, and water ($H_2O$) 1000 ml at a room temperature;

g) flushing the $\alpha$-$Al_2O_3$ with water;

h) dipping the $\alpha$-$Al_2O_3$ in a second sensitizing and activating solution including palladium chloride ($PdCl_2$) 0.25 g, hydrogen chloride (9.6N) (HCl) 2.5 ml, and water ($H_2O$) 1000 ml at a room temperature for from about 1 minute to about 2 minutes; and i) flushing the $\alpha$-$Al_2O_3$ with water; or The second kind including procedures (A'):

f') dipping the $\alpha$-$Al_2O_3$ in a first sensitizing and activating solution including stannum chloride ($SnCl_2.H_2O$) 0.5 g, palladium chloride ($PdCl_2$) 25 g, hydrogen chloride (9.6N) (HCl) 300 ml and water ($H_2O$) 600 ml at a temperature from about 40° C. to about 60° C. for from about 1 minute to about 2 minutes;

g') flushing the $\alpha$-$Al_2O_3$ with a water;

h') dipping the $\alpha$-$Al_2O_3$ in a hydrogen chloride solution (10 v/o) at a room temperature for from about 1 minute to about 2 minutes; and i') flushing the $\alpha$-$Al_2O_3$ with a water.

The aluminum powder can alternatively be processed by the following pre-treatment procedures (B):

Defatting the aluminum powder, flushing the aluminum powder with a basic solution, flushing the aluminum powder with an acid solution, and subjecting the aluminum powder to an ultrasonic vibration to speed up a reaction therefor and improve a uniformity of the aluminum powder, or procedures (B'):

i) providing the aluminum powder;

j) providing a replacing solution containing replacing nickel ions; and k) permitting the replacing nickel ions to replace aluminum ions ionized from the aluminum powder for forming a thin mono-layer of nickel on a surface of the aluminum powder. Besides, the conditions for the replacing solution in step j) are shown in TABLE 2.

Four preferred embodiments according to the present invention are described here for a better understanding:

TABLE 2

| | REPLACING PLATING CONDITION |
|---|---|
| nickel chloride | 30 g/l |
| sodium citrate | 20 g/l |
| ammonia chloride | 7 g/l |
| sodium fluoride | 0.5 g/l |
| pH value | 8–9 |
| reaction temperature | room temperature |

EXAMPLE 1

An aluminum powder (having a diameter about 20 μm, weight about 14.500 g) is dipped in the replacing solution at a room temperature for about 2 hours, then flushed by water to be neutral. Then $\alpha$-$Al_2O_3$ particles (having a diameter about 18 μm, weight about 2.910 g) are dipped in the first sensitizing and activating solution at a room temperature for about 10 minutes, flushed by water, dipped in the second sensitizing and activating solution at a room temperature for about 1 minute to about 2 minutes, and then flushed by water. The processed aluminum powder and the $\alpha$-$Al_2O_3$ powder are then executed with a reducing plating according to reducing plating condition 3 in Table 1, and is stirred by a magnetic stirrer to improve a reaction uniformity. After 20 minutes, The nickel powder (having a diameter about 10 μm, weight about 87.00 g) is added in the reducing solution to adjust the content of nickel and boron. After the total reaction is completed, the obtained powder is flushed with water. After step r)–step x), the high-density composite flake including about 5 vol. % (volume percentage) $\alpha$-$Al_2O_3$ particles, about 24 at. % (atom percentage) Al and about 0.1 wt. % weight percentage) boron is obtained.

EXAMPLE 2

The details of this example are almost the same as those in Example 1. Whereas, the weight of the added $\alpha$-$Al_2O_3$ particles is about 6.150 g, so the obtained composite flake includes about 10 vol. % $\alpha$-$Al_2O_3$ particles, about 24 at. % aluminum and about 0.1 wt. % boron.

EXAMPLE 3

The details of this example are also almost the same as those in Example 1. Whereas, the weight of the added $\alpha$-$Al_2O_3$ particles is about 13.840 g, so the obtained composite flake includes about 20 vol. % $\alpha$-$Al_2O_3$ particles, about 24 at. % aluminum and about 0.1 wt. % boron.

EXAMPLE 4

The details of this example are also almost the same as those in Example 1. Whereas, the whisker-shaped $\alpha$-$Al_2O_3$ is applied in this example, and the weight of the added $\alpha$-$Al_2O_3$ particles is about 2.910 g, so the obtained composite flake includes about 5 vol. % $\alpha$-$Al_2O_3$ particles, about 24 at. % aluminum and about 0.1 wt. % boron.

If the reinforced material is not applied, the present method can obtain a simple mono-phase $Ni_3Al$ intermetallic compound. TABLE 3 shows the analysis results of the final product which is dissolved by an acid (wherein $\alpha$-$Al_2O_3$ is not dissolved) to be examined by ICP-AES. The basic composition of the correct intermetallic compound should be $Ni_{76}Al_{24}$+0.1% B, which for simplicity, is represented by $Ni_3Al$.

TABLE 3

| | additive | | | | | |
|---|---|---|---|---|---|---|
| aluminum powder | nickel (at. %) | aluminum (at. %) | boron (wt. %) | sulfur (ppm) | iron (ppm) | copper (ppm) |
| 7.45 g/l | balance | 23.89 | 0.125 | <10 | 56 | <3 |

Figure 2:
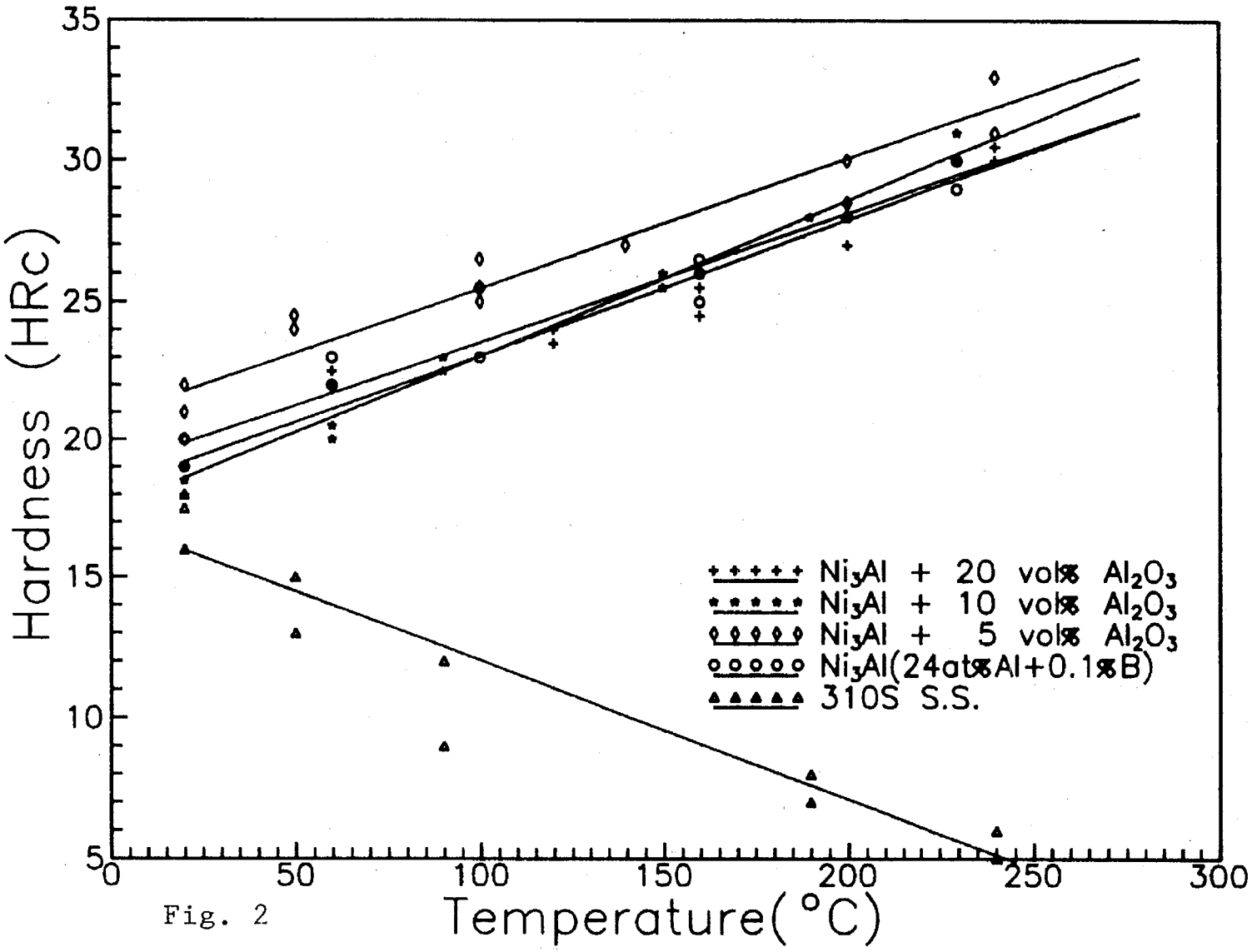
FIG. 2 shows different hardnesses of the final products of different examples according to the present invention and the reference examples of 310S stainless steel and the pure $Ni_3Al$ (24 a/o Al) intermetallic compound under different temperatures.

FIG. 2 shows different hardnesses of the final products of the examples according to the present invention and the reference examples of the 310S stainless steel and the pure $Ni_3Al$ (24 a/o Al) intermetallic compound under different temperatures. Apparently, the final product having the additive $\alpha$-$Al_2O_3$ as the reinforced material still has the excellent property of thermal hardening as that of the basic material $Ni_3Al$.

Figure 3:
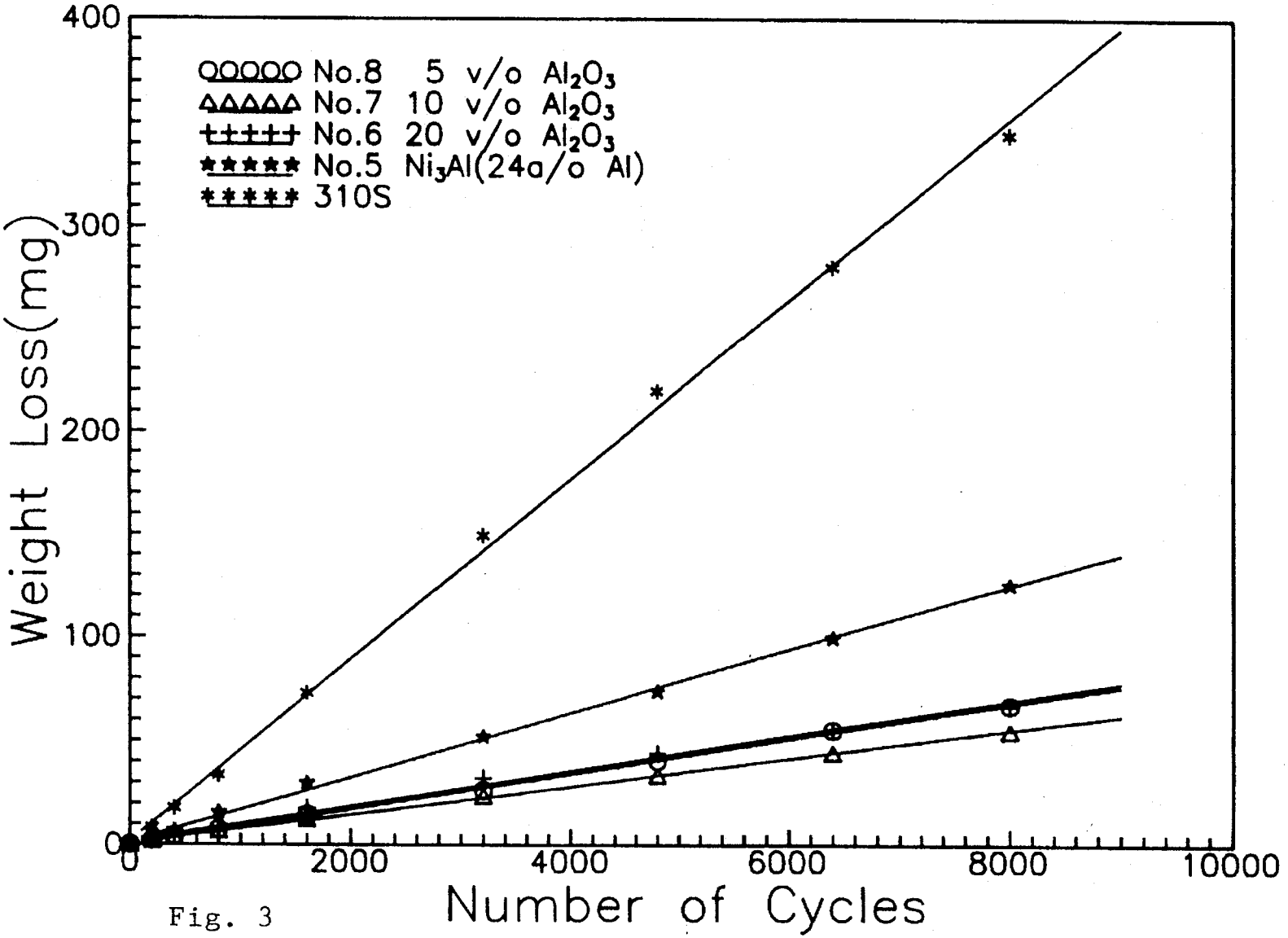
FIG. 3 shows the results of the anti-wearing experiment for the final products of different examples according to the present invention and the reference examples of 310S stainless steel and the pure $Ni_3Al$ (24 a/o Al)

FIG. 3 shows the results of the anti-wearing experiment for the final products of the examples according to the present invention and the reference examples of 310S stainless steel and the pure $Ni_3Al$ (24 a/o Al). The results indicate that the $Ni_3Al$ has a better wear-resistance than that of the 310S stainless steel, and that $Ni_3Al$ with additive $\alpha$-$Al_2O_3$ reinforced material has a relatively better wear-resistance.

Figure 4:
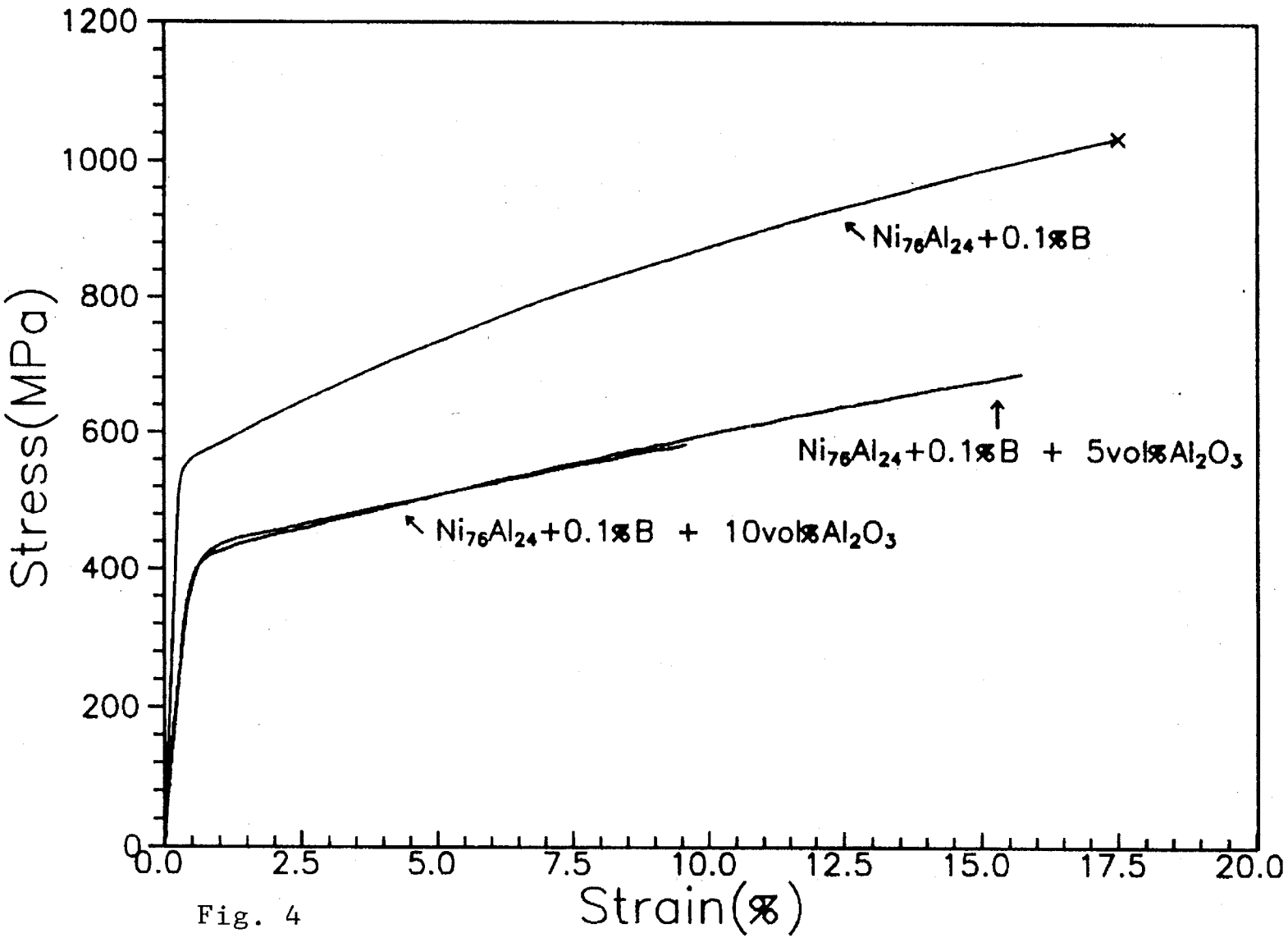
FIG. 4 is a typical tensile (stress-strain) curves (test) for the second example according to the present invention and the reference examples of 310S stainless steel and the pure $Ni_3Al$ (24 a/o Al)

FIG. 4 is a typical tensile (stress-train) curve (test) for the reference examples and the final product in the second example according to the present invention, and shows the excellence of the present method. The elongation and the tensile strength are the most outstanding properties. The elongation and the tensile strength for the pure $Ni_3Al$ without the addition of the reinforced material are respectively 17% and 1035 MPa. The elongation of the final product in the first example ($Ni_3Al$+5 vol. % $Al_2O_3$) according to the present invention is up to 15.7% and the elongation of the final product in the second example ($Ni_3Al$ +10 vol. % $Al_2O_3$) according to the present invention is up to 9.5%. These values are much better than those disclosed in J. Metals September 1988, pp. 14–17 by A. Boss et al in 1988 and those disclosed in THE INTERNATIONAL JOURNAL OF POWDER METALLURGY, VOL. 24, No. 4, pp 315–325 by Jason S. C. Wang.

Figure 5A:
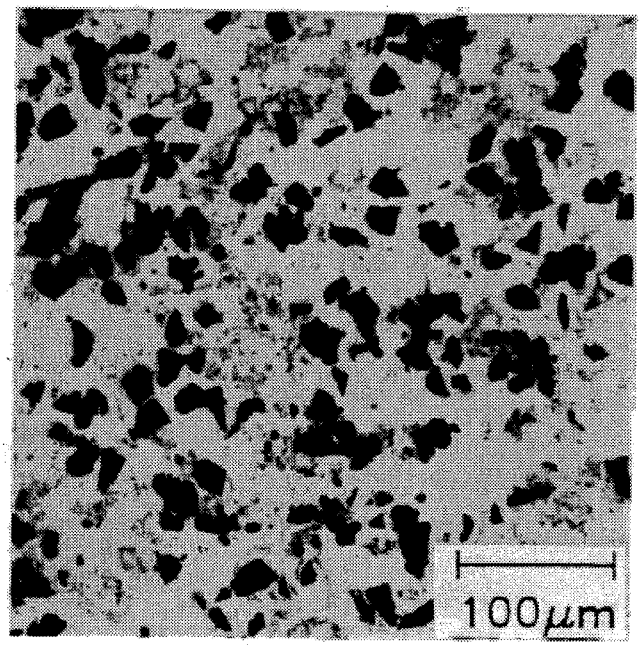
FIG. 5A and FIG. 5B show photographs taken by a low-magnification optical microscope for the third example according to the preferred invention.
Figure 5B:
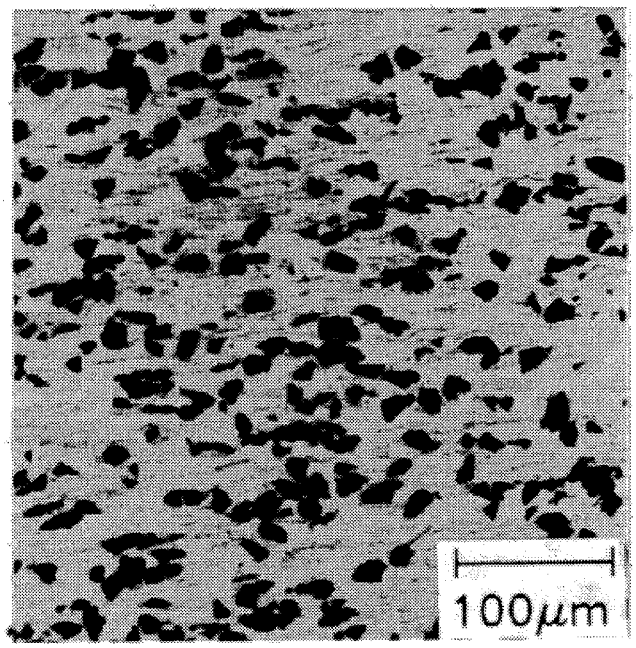

FIGS. 5A and 5B show photographs taken by a low-magnification optical microscope for the third example according to the present invention. The $\alpha$-$Al_2O_3$ particles are randomly distributed in the rolled surface (as shown in FIG. 5A), but in the plane vertical to the rolled surface (as shown in FIG. 5B), and the distribution of the $\alpha$-$Al_2O_3$ particles has a trend to be parallel to the rolled surface. Therefore, without any mechanical mixing, the uniformly mixed composite powder can be easily obtained. In addition, there is no hole in the final product, so it is obvious that the final product manufactured by the present method has a relatively high density.

Figure 6A:
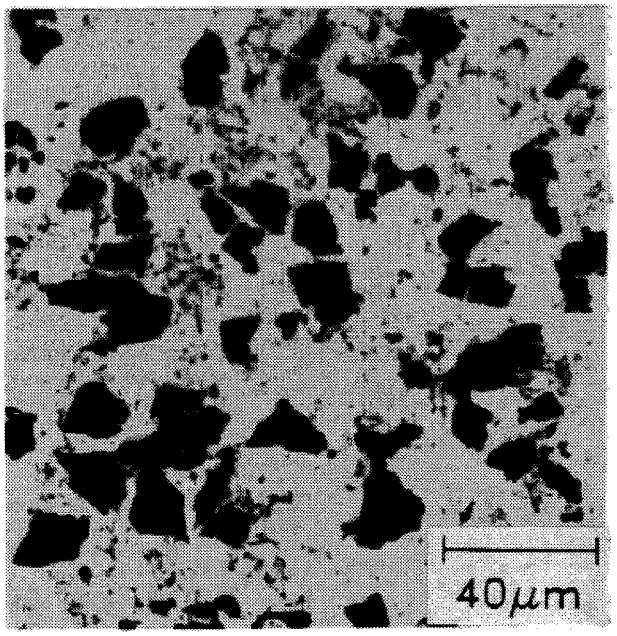
FIG. 6A and FIG. 6B show photographs taken by a high-magnification optical microscope for the third example according to the present invention.
Figure 6B:
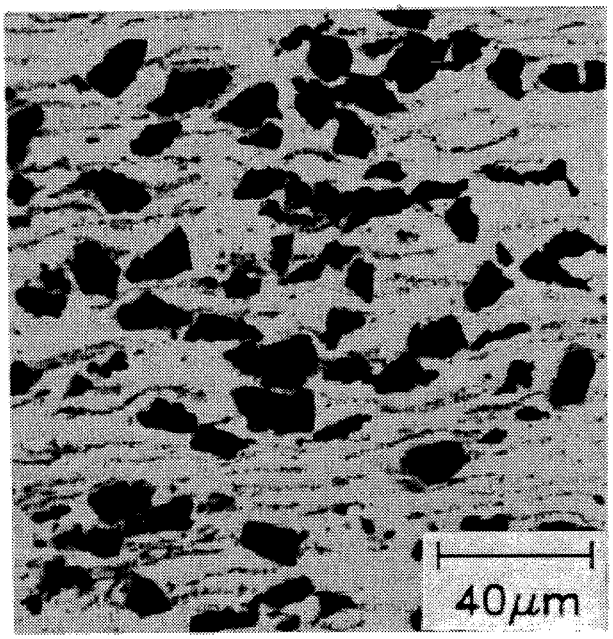

FIG. 6A is a photograph taken by a high-magnification optical microscope for the third example according to the present invention and taken in the rolled surface. FIG. 6B is a photograph taken by a high-magnification optical microscope for the third example according to the present invention and taken in the plane vertical to the rolled surface. The crack is vertical to the rolling direction and the additive $\alpha$-$Al_2O_3$ particles have a breaking phenomenon.

Figure 7A:
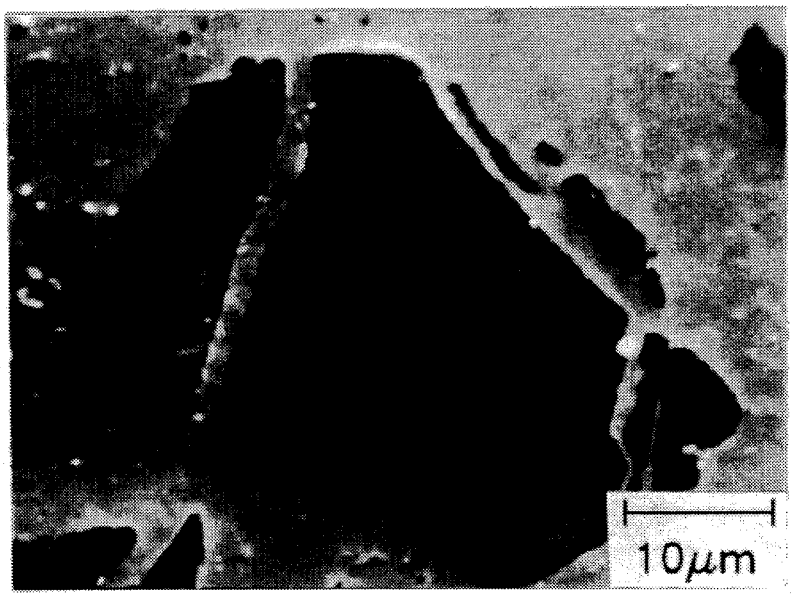
FIG. 7A and FIG. 7B show SEM photographs for the first example according to the present invention.
Figure 7B:
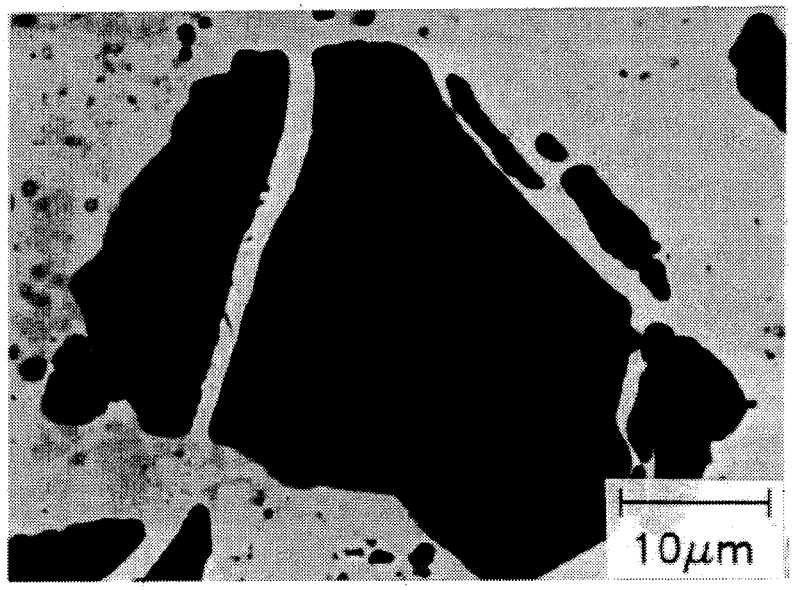

FIG. 7A is an SEM photograph showing a secondary electrons image of the first example and FIG. 7B is a SEM photoghraph showing a backscattered electrons image of first example. We can find that the space resulting from the broken $\alpha$-$Al_2O_3$ particles is filled with $Ni_3Al$ and thus there is no hole left. Therefore, after being homogenizedly heat-treated, the final product has a relatively excellent adhesiveness between the reinforced material and $Ni_3Al$.

Figure 8:
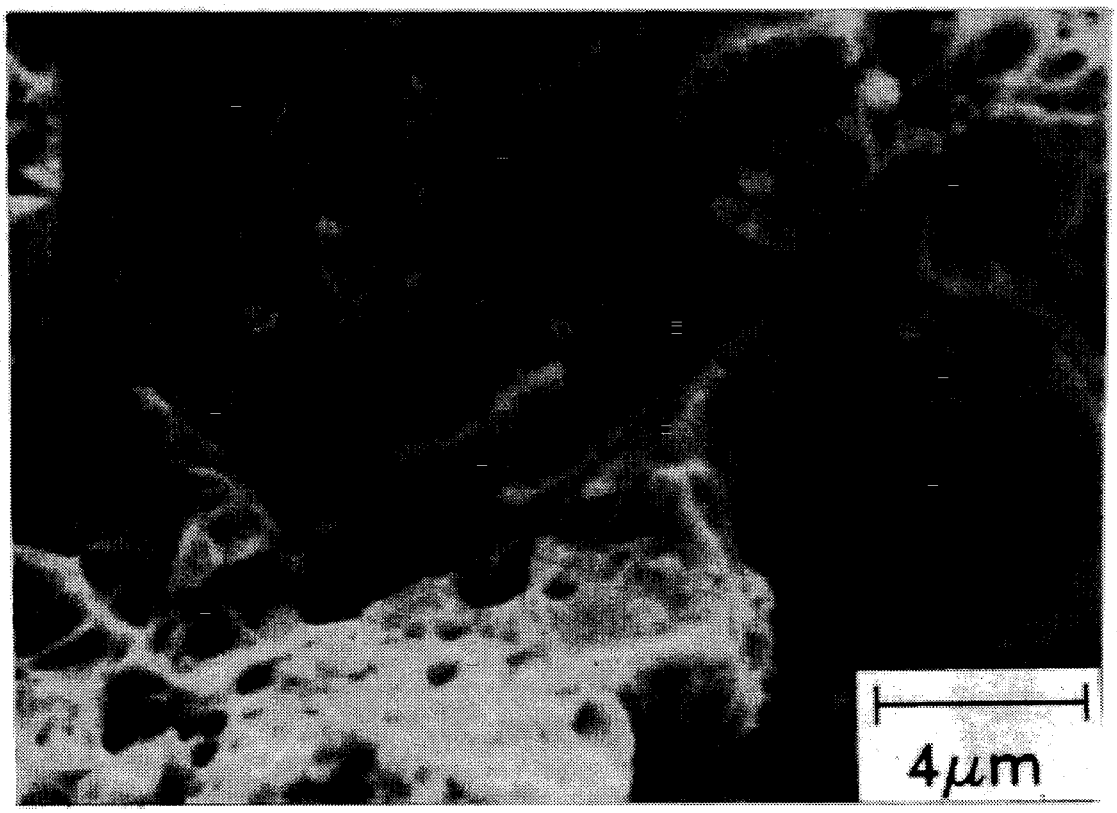
FIG. 8 is a SEM photograph showing a fractured surface of a tensile test for a test specimen of the second example according to the present invention.

FIG. 8 is an SEM photograph showing a fractured surface of a tensile test for a test specimens of the second example according to the present invention. We can observe that typical ductile section (being dimply) to evidence that the final product manufactured by the present method has a relatively excellent toughness.

To sum up, the present method has the following advantages:

I) The elongation of the final product is relatively high.

II) The tensile strength of the final product is relatively high.

III) The present method needs not apply the hot isostatic press.

IV) The method is relatively simple and convenient.

V) The cost thereof is relatively low.

VI) The size of the final product according to the present invention is not limited to the inner diameter of the HIP or HP.

VII) The purpose of the mass production can be easily obtained.

VIII) The elasticity and the yield strength are relatively sound.

While the present invention has been described in connection with what are presently considered to be the most practical and preferred embodiments, it is to be understood that the invention is not to be limited to the disclosed embodiments but on the contrary, is intended to cover various modifications and equivalent arrangements included within the spirit and scope of the appended claims whose scope is to be accorded the broadest interpretation so as to encompass all such modifications and equivalent structures.

What is claimed is:

1. A method of manufacturing an Ni—Al intermetallic compound matrix composite comprising steps of:

a) providing an aluminum powder;

b) providing a reinforced material;

c) providing a reducing solution containing a reducing agent and nickel ions to be reduced;

d) adding said aluminum powder and said reinforced material into said reducing solution; and e) permitting said reducing agent to reduce said nickel ions to be reduced to be respectively deposited on said aluminum powder and said reinforced material.

2. A method according to claim 1 wherein said reinforced material is whisker-shaped.

3. A method according to claim 2 wherein said reinforced material has a length from about 0.1 μm to about 10 cm.

4. A method according to claim 1 wherein said reinforced is particle-shaped.

5. A method according to claim 4 wherein said particle-shaped reinforced material has a diameter from about 0.1 μm to about 100 μm.

6. A method according to claim 1 wherein said reinforced material is $\alpha$-$Al_2O_3$.

7. A method according to claim 6 wherein said $\alpha$-$Al_2O_3$ is processed by a pre-treatment procedure.

8. A method according to claim 7 wherein said pre-treatment procedure includes steps of:

f) dipping said $\alpha$-$Al_2O_3$ in a first sensitizing and activating solution;

g) flushing said $\alpha$-$Al_2O_3$ with water;

h) dipping said $\alpha$-$Al_2O_3$ in a second sensitizing and activating solution; and i) flushing said $\alpha$-$Al_2O_3$ with water.

9. A method according to claim 8 wherein said first sensitizing and activating solution includes stannum chloride ($SnCl_2.H_2O$), hydrogen chloride (HCl), and water ($H_2O$).

10. A method according to claim 8 wherein said second sensitizing and activating solution includes palladium chloride ($PdCl_2$), hydrogen chloride (HCl), and water ($H_2O$).

11. A method according to claim 1 wherein said reinforced material is a ceramic powder.

12. A method according to claim 11 wherein said ceramic powder is one selected from a group consisting of an oxide, a nitride, a carbide, and a boride.

13. A method according to claim 1 wherein said aluminum powder is processed by a pre-treatment procedure.

14. A method according to claim 13 wherein said pre-treatment procedure includes steps of defatting said aluminum powder, flushing said aluminum powder with a basic solution, and flushing said aluminum powder with an acid solution.

15. A method according to claim 14 wherein said pre-treatment procedure further includes a step of subjecting said aluminum powder to an ultrasonic vibration to speed up a reaction therefor and improve a uniformity of said aluminum powder.

16. A method according to claim 13 wherein said pre-treatment procedure includes steps of:

i) providing said aluminum powder;

j) providing a replacing solution containing replacing nickel ions; and k) permitting said replacing nickel ions to replace aluminum ions ionized from said aluminum powder for forming a thin mono-layer of nickel on a surface of said aluminum powder.

17. A method according to claim 16 wherein said replacing solution includes a metal salt and a reducing agent.

18. A method according to claim 17 wherein said replacing solution further includes at least one selected from a group consisting of a pH regulator, a buffer, a complexing agent, a stabilizer, and an improver.

19. A method according to claim 16 wherein said replacing solution has a pH value ranging from about 8 to about 9 and a reaction temperature at room temperature, and includes nickel chloride ($NiCl_2.6H_2O$), sodium citrate ($Na_3C_6H_5O_7.2H_2O$), and ammonia chloride ($NH_4Cl$), sodium fluoride (NaF).

20. A method according to claim 1, further comprising after step e) steps of:

o) providing a pure nickel powder;

p) adding a proper amount of said pure nickel powder in said reducing solution at a proper time for adjusting a ratio of said aluminum and said nickel; and q) obtaining an Ni—Al, Ni—Ni, and Ni— reinforced material composite powder.

21. A method according to claim 1 wherein said reducing solution contains boron ions.

22. A method according to claim 21, further comprising after step e) steps of:

o') providing a pure nickel powder;

p') adding a proper amount of said pure nickel powder in said reducing solution at a proper time for adjusting a ratio of said aluminum, said boron, and said nickel; and q') obtaining an Ni—B—Al, Ni—B—Ni, and Ni—B— reinforced material composite powder.

23. A method according to claim 21 wherein said reinforced material is $\alpha$-$Al_2O_3$ particles.

24. A method according to claim 23 wherein said aluminum powder, said nickel powder, and said $\alpha$-$Al_2O_3$ particles have a diameter ratio from about 2.0:1:1.1 to about 2.5:1:2.0.

25. A method according to claim 23 wherein said aluminum powder, said nickel powder, and said $\alpha$-$Al_2O_3$ particles have a preferred diameter ratio 2.2:1:1.7.

26. A method according to claim 23, further comprising after step q') steps of:

r) drying said composite powder;

s) degassing said composite powder at about 450° C. under less than about $10^{-5}$ torr;

t) canning said composite powder in a stainless steel tube in air;

u) sealing both ends of said tub; and x) cold-rolling said tube containing said composite powder to form a composite flake.

27. A method according to claim 26 wherein said composite flake is pre-sintered by a first heat treatment at about 650° C. for forming a pre-sintered specimen.

28. A method according to claim 27 wherein said pre-sintered specimen is sintered by a second heat treatment at about 1200° C. for forming a sintered specimen.

29. A method according to claim 28 wherein said sintered specimen is then released from said tube, cold-rolled, and homogenized at about 1200° C.

30. A method according to claim 1 wherein said reducing solution includes a metal salt and a reducing agent.

31. A method according to claim 30 wherein said reducing solution further includes a pH value regulator, a buffer, a complexing agent, a stabilizer, and an improver.

32. A method according to claim 1 wherein said reducing solution has a pH value ranging from about 6 to about 7 and a reaction temperature about 70° C., and includes nickel chloride ($NiCl_2.6H_2O$), dimethylamine borane (DMAB), sodium acetate ($CH_3COONa.3H_2O$), and lead nitrate ($Pb(NO_3)_2$).

33. A method according to claim 1 wherein said reducing solution has a pH value ranging from about 7 to about 8 and a reaction temperature about 70° C., and includes nickel chloride ($NiCl_2.6H_2O$), dimethylamine borane (DMAB), sodium citrate ($Na_3C_6H_5O_7.2H_2O$), ammonia chloride ($NH_4Cl$), and lead nitrate ($Pb(NO_3)_2$).

34. A method according to claim 1 wherein said reducing solution has a pH value ranging from about 6 to about 7 and a reaction temperature about 70° C., and includes nickel chloride ($NiCl_2.6H_2O$), dimethylamine borane (DMAB), monalic acid ($HOOCH_2COOH$), and thiourea ($NH_2COSC_2H_5$).

35. A method according to claim 1 wherein said reducing solution has a pH value ranging from about 8 to about 10 and a reaction temperature at room temperature, and includes nickel chloride ($NiCl_2.6H_2O$), sodium brohydride ($NaBH_4$), ammonia chloride ($NH_4Cl$), sodium citrate ($Na_3C_6H_5O_7.2H_2O$), sodium acetate ($CH_3COONa.3H_2O$), and lead nitrate ($Pb(NO_3)_2$).

36. A method according to claim 1 wherein said Ni—Al intermetallic compound is one selected from a group consisting of $Ni_3Al$, NiAl, $Ni_2Al_3$, $NiAl_3$, $Ni_3Al$+B, NiAl+ B, $Ni_2Al_3$+B, and $NiAl_3$+B.

37. A method according to claim 1 wherein said aluminum powder has a purity about 99.5% and an average diameter about 20 μm.

* * * * *